US006315036B1

(12) United States Patent
Pogue et al.

(10) Patent No.: US 6,315,036 B1
(45) Date of Patent: Nov. 13, 2001

(54) MANIFOLD REINFORCEMENT WEBBING FOR HEAT EXCHANGERS

(75) Inventors: Bill P. Pogue, Trabuco Canyon; Timothy R. Moorhouse, Long Beach, both of CA (US)

(73) Assignee: Honeywell International Inc., Morristown, NJ (US)

( * ) Notice: Subject to any disclaimer, the term of this patent is extended or adjusted under 35 U.S.C. 154(b) by 19 days.

(21) Appl. No.: 09/593,235

(22) Filed: Jun. 14, 2000

(51) Int. Cl.[7] ..... F28F 9/02; F28F 9/007
(52) U.S. Cl. ..... 165/173
(58) Field of Search ..... 165/67, 76, 158, 165/173, 906; 410/97, 100

(56) References Cited

U.S. PATENT DOCUMENTS

| | | | | |
|---|---|---|---|---|
| 3,897,919 | * | 8/1975 | Weingarten | 244/118 R |
| 4,158,985 | * | 6/1979 | Looker et al. | 87/12 |
| 4,311,339 | * | 1/1982 | Heath | 297/487 |
| 5,163,505 | * | 11/1992 | Hoffman et al. | 165/67 |
| 5,699,852 | * | 12/1997 | Park et al. | 165/76 |

* cited by examiner

*Primary Examiner*—Allen Flanigan
(74) *Attorney, Agent, or Firm*—William J. Zak, Jr. Esq.

(57) ABSTRACT

A heat exchanger includes a core assembly, a plurality of manifolds for the core assembly, and a webbing wrapped around a portion of the core assembly. The webbing secures at least one of the manifolds to the core assembly.

20 Claims, 3 Drawing Sheets

MANIFOLD REINFORCEMENT WEBBING FOR HEAT EXCHANGERS

BACKGROUND OF THE INVENTION

The present invention relates to heat exchangers. More specifically, the present invention relates to the securing of manifolds to a heat exchanger core assembly.

Heat exchangers may be used in a variety of applications. Heat exchangers may be used to transfer heat from hot air to cold air and, more generally, from hot fluid to cold fluid. The fluids that can be handled range from hot exhaust gases to cryogenic fluids.

Heat exchangers are commonly used in aircraft environmental control systems. A typical aircraft heat exchanger includes a core assembly and inlet and outlet manifolds, the manifolds being bonded, welded, riveted or otherwise secured to the core assembly. The manifolds direct hot and cold fluids or air to and from hot side and cold side passageways extending through the core assembly. During operation of the heat exchanger, hot compressed bleed air is supplied to the hot side passageways and ambient air is supplied to the cold side passageways. Heat of compression is exchanged from the hot circuit flowing through the hot side passageways to the cold circuit flowing through the cold side passageways. The bleed air may be supplied by a compressor stage of an aircraft engine.

The bleed air is supplied at high pressures. Moreover, aircraft environmental controls systems are often operated at high altitudes and extreme temperatures. In such a hostile environment, structural loading on the manifolds can become unbalanced.

The unbalanced loading can cause the manifolds to separate from the core assembly. If separation occurs, the consequences can be catastrophic.

SUMMARY OF THE INVENTION

According to one aspect of the present invention, a heat exchanger includes a core assembly; a plurality of manifolds for the core assembly; and a webbing wrapped around a portion of the core assembly. The webbing secures at least one manifold to the core assembly.

DETAILED DESCRIPTION OF THE INVENTION

The present invention is embodied in a heat exchanger including a core assembly, inlet and outlet manifolds for the core assembly, and a manifold reinforcement webbing wrapped around a portion of the core assembly. The core assembly is not limited to any particular type. For example, the core assembly may be a plate-fin type. The inlet and outlet manifolds may be (but do not have to be) welded or otherwise bonded to the core assembly. The reinforcement webbing secures the inlet and outlet manifolds to the core assembly. The reinforcement webbing provides strength in highly stressed areas and thereby prevents manifold/core assembly separation under hostile environmental conditions. Yet when compared to conventional methods of securing the manifolds to the core assembly, the reinforcement webbing provides greater strength at a fraction of the weight.

Figure 1:
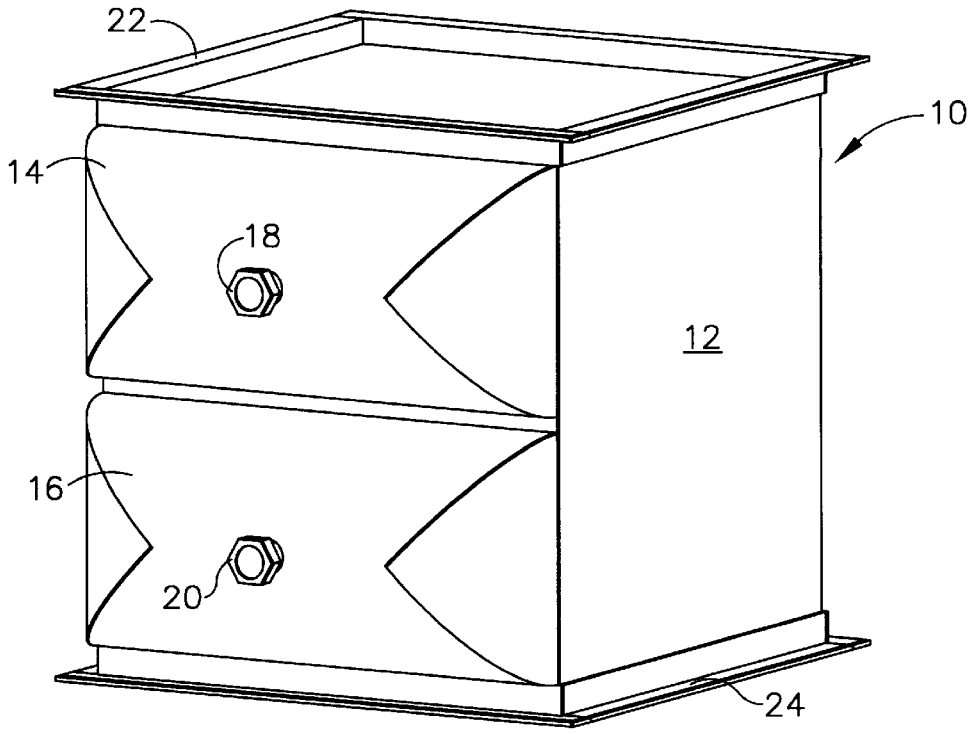
FIG. 1 is an illustration of a heat exchanger prior to wrapping a manifold reinforcement webbing around portions of its core assembly.

Reference is made to FIG. 1, which shows the heat exchanger 10 without the reinforcement webbing. The heat exchanger 10 includes a core assembly 12, an inlet manifold 14 attached to one side of core assembly 12, and an outlet manifold 16 attached to the same side of the core assembly 12, adjacent the inlet manifold 14. The inlet manifold 14 includes an inlet opening 18, and the outlet manifold 16 includes an outlet opening 20. Although a single opening is shown for each manifold, the manifolds 14 and 16 may have a plurality of inlet and outlet openings disposed parallel to one another. The inlet and outlet manifolds 14 and 16 may be formed as separate members positioned adjacent to one another or, preferably, as a single member. Although the manifolds 14 and 16 are shown as being mounted to the same side of the core assembly 12, the inlet and outlet manifolds 14 and 16 may be mounted to opposite sides of core assembly 12.

The inlet manifold 14 may direct a high pressure fluid to first fluid passageways within the core assembly 12, and the outlet manifold 16 may direct the high pressure fluid away from the first fluid passageways. Though not shown, it is evident that the first fluid passageway has a curved configuration (because the inlet and outlet openings 18 and 20 are disposed on the same side of core assembly 12). As a result, the pressurized fluid flows twice or more through the core assembly 12 and the first fluid passageways are commonly referred to as a multi-flow or reverse flow type. There will typically be a pressure drop across the first fluid passageways during operation of the heat exchanger 10. Magnitude of the pressure drop will depend in part upon the flow configuration within the core assembly 12.

A pair of flange portions 22 and 24 are on opposite sides of the core assembly 12. These flange portions 22 and 24 allow a second pair of manifolds to be attached to the core assembly 12. The second pair of manifolds direct a lower pressure fluid to second fluid passageways within the core assembly 12 and direct the lower pressure fluid away from the second fluid passageways. The second fluid passageways may be relatively straight. Still there will be a pressure drop across the second fluid passageways during operation of the heat exchanger 10.

The core assembly 12 may be metallic or non-metallic. Similarly, the manifolds 14 and 16 may be metallic or non-metallic.

Figure 2:
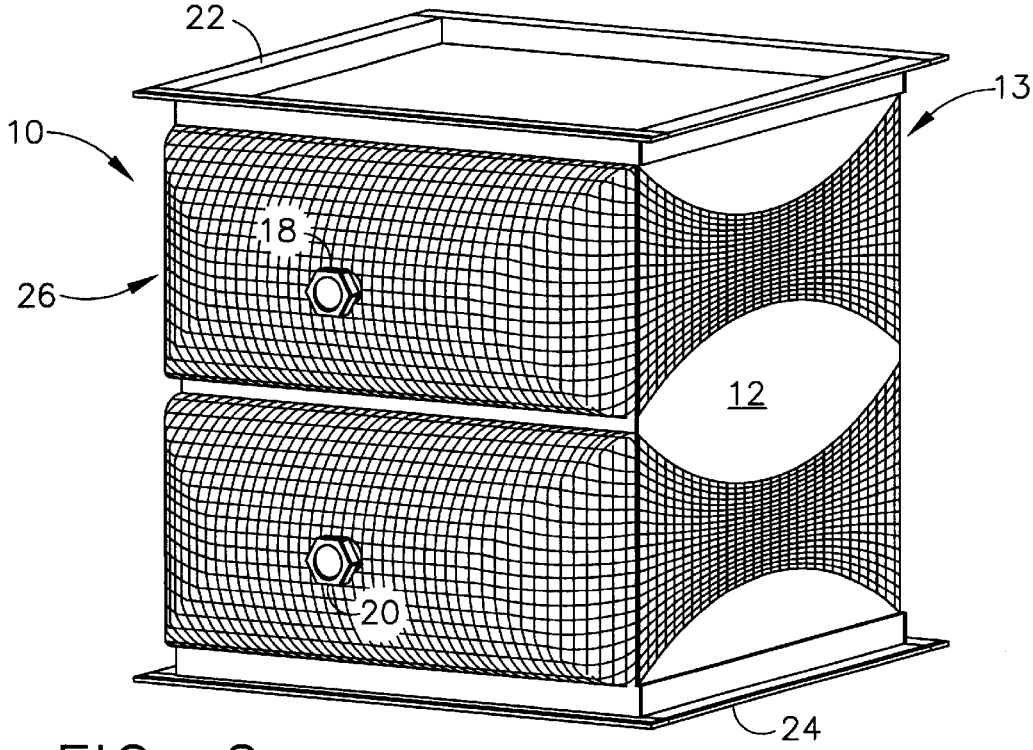
FIG. 2 is an illustration of a heat exchanger after the webbing has been wrapped around the core assembly.
Figure 3:
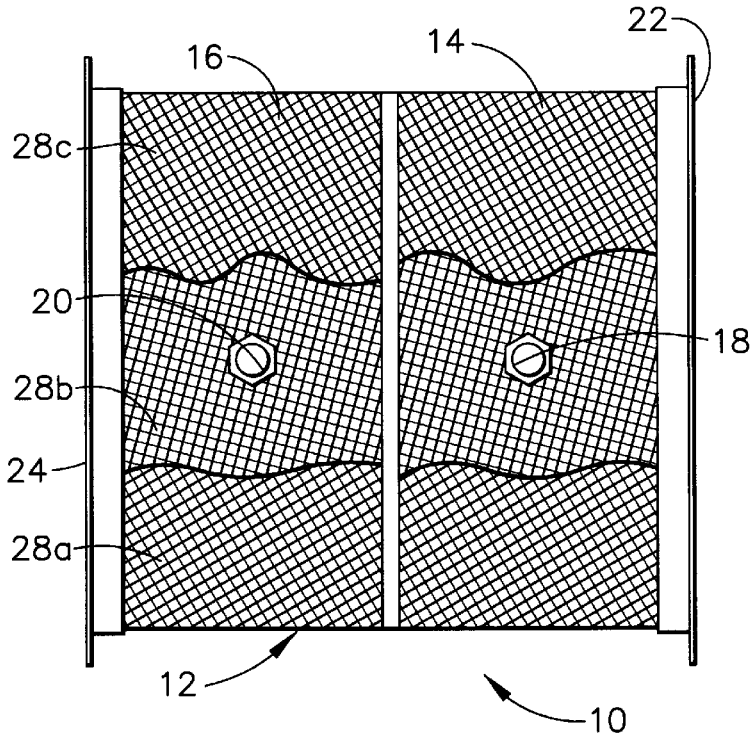
FIG. 3 is a front view of the heat exchanger of FIG. 2, different orientations of different strand layers of the webbing being shown.
Figure 4:
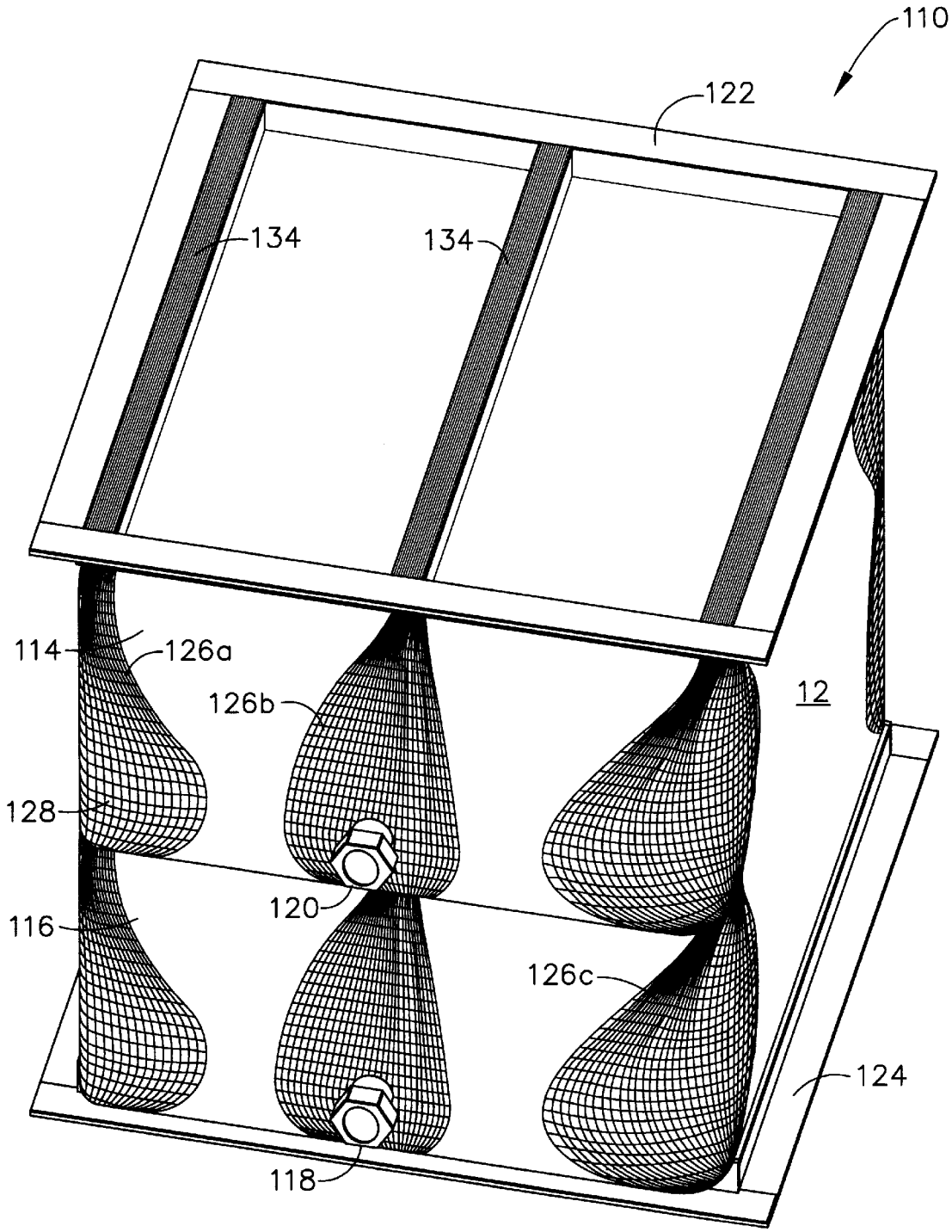
FIG. 4 is an illustration of an alternative heat exchanger after the webbing has been wrapped around the core assembly.

Turning now to FIGS. 2 to 4, the manifold reinforcement webbing 26 is wrapped around highly stressed portions of the core assembly 12 and the manifolds 14 and 16, creating a boundary that maintains both pressure and load requirements. The webbing 26, which resembles a reinforced cloth, may include a number of separate strands 28 that join one another. The strands 28 may be formed of a composite material such as glass, carbon, KEVLAR®, polymide laminates or reinforced plastics. Alternatively, a pre-impregnated material (pre-preg) may be used. The strands 28 may even be made of a metal such as steel. Characteristics such as diameter, stiffness and tensile strength of the strands 28 are application-specific. A plurality of separate strands 28 is preferred because the plurality of strands 28 together exhibit sufficient strength to maintain the manifolds 14 and 16 in position in spite of the unbalanced loading on the heat exchanger 10 during operation.

FIG. 2 shows one wrapping pattern in which the strands 28 are wrapped around the entire surfaces of the manifolds 14 and 16, except for the openings 18 and 20. The strands 28 are also wrapped around a side plate 13 (not visible, but referenced generally at 13) of the core assembly 12, opposite the manifolds 14 and 16. The webbing 28 is wrapped around side plates of the core assembly 12 so as not to interfere with the air flow or manifolds (not shown) that are attached to the flange portions 22 and 24.

Attention is directed to FIG. 3, which shows that the webbing 26 has multiple layers 28*a*, 28*b* and 28*c* of strands 28. Each of these layers 28*a*, 28*b* and 28*c* contributes to the overall strength of the webbing 26. In order to maximize the overall strength, the layers 28*a*, 28*b* and 28*c* may be formed at angles to one another, creating a wound strand assembly similar to the plies of an automobile tire. The layers 28*a*, 28*b* and 28*c* are preferably oriented approximately at an angle of forty five degrees (45°) relative to one another.

FIG. 4 shows an alternative heat exchanger 110 in which three separate groups 126*a*, 126*b* and 126*c* of webbing strands 128 secure the manifolds 114 and 116 to the core assembly 12. The groups 126*a*, 126*b* and 126*c* secure a middle portion and end portions of the manifolds 114 and 116. Each group 126*a*, 126*b* and 126*c* of strands 128 is aligned with, and channeled by, a surface extending from a reinforcement bar of the core assembly 112. As a result, none of the strands 128 blocks the air flow passageways through core assembly 112.

Figure 5:
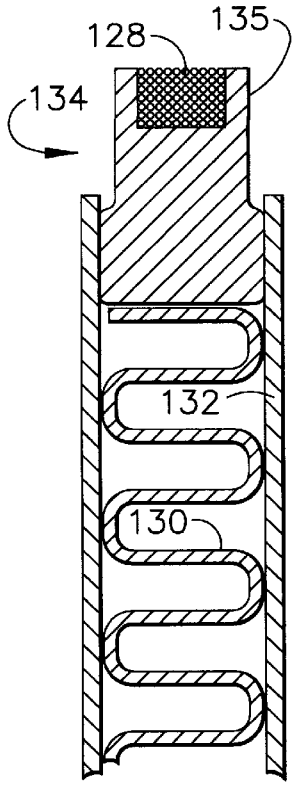
FIG. 5 is a view of an extended reinforcement bar of the heat exchanger of FIG. 4, strands of the webbing being channeled by the extended reinforcement bar.

FIG. 5 shows a modified reinforcement bar 134 of the core assembly 112 in greater detail. A core assembly 112 of the plate-fin type includes a stack of fin assemblies 130 and tube plates 132. The tube plates 132, positioned between the fin assemblies 130, support the fin assemblies 130 in their proper positions while preventing fluid from leaking between fluid passageways. Enclosure bars and reinforcement bars 134 are secured at the ends of the tube plates 132 and provide a framework for the fin assemblies 130. The reinforcement bars 134 may be disposed about the core assembly 12.

Some of the reinforcement bars (including the reinforcement bar 134 shown in FIG. 5) are modified to have an extended substantially yoke-shaped support surface 135 for supporting and channeling the web strands 128. The extended surface 135 could extend away or toward the core assembly 112, depending upon compressive pressure to be exerted by the web material on the heat exchanger 110. The number, location and spacing of modified reinforcement bars 134 is a design choice.

The core assembly 112, including the reinforcement bars 134, may be made of a metal such as steel or aluminum, or a non-metallic material such as a carbon composite. If the core assembly 112 is made of an extrudable material such as aluminum, the reinforcement bars 134 may be formed by extrusion.

After the strands have been laid in the extended surface 135 and the webbing 126 has been wrapped around portions of the core assembly 112, the flanges 122 and 124 (see FIG. 4) may be installed. Thus, the strands 128 are pinned by the flanges 122 and 124.

A method of wrapping a carbon fiber webbing around a core assembly will now be described. Thee method is performed after the core assembly has been fabricated and the manifolds have been bonded to or positioned against the core assembly.

Single or multiple plies (also referred to as "layers") of the resin-impregnated carbon fiber material are placed one at a time in a mold until the desired build-up is obtained. The heat exchanger becomes the mandrel to contour to the webbing. Each ply will usually increase the thickness of the webbing by about 0.010 in. Each ply may be laid up at a substantially forty five degree angle with respect to the previous ply, wherever such an orientation can be achieved. The plies are cut to their proper length, generally allowing a small portion to extend beyond the trim of the mold. A template may be used to cut the carbon fiber material.

Once the lay-up is achieved on the heat exchanger, individual plies may be heat-tacked by hot air blowers. The lay-up may be covered with a layer of perforated cellophane sheet.

A vacuum bag may be used to reduce bonding resins and improve strength. The vacuum bag is applied to the lay-up, with the bag enclosing the mold and carbon fiber plies. The bag is sealed and a vacuum is slowly applied. After the bag has been drawn tightly against the lay-up and mold, air and excess resin are wiped out using rollers or similar devices.

The webbing is then cured. During curing, the temperature is raised in steps until reaching a temperature of approximately 350° F. After the webbing has been cured, the vacuum is eliminated. The material may thereafter under go additional heating during a post cure process. Once the webbing has been cured, the heat exchanger is ready for operation.

Components of heat exchanger may be repaired or replaced after the webbing has been cured. The webbing is cut away, broken away or otherwise removed to gain access to the components. After the components have been replaced, a new webbing may be wrapped around the core assembly.

The webbing can provide very high mechanical strength in both the longitudinal and transverse directions. However, the webbing may be used even when the manifolds are welded or otherwise bonded to the core assembly. The combination effectively combines the strength of the bonded joint to the inherent strength of the web. Moreover, it allows for smaller weld buildups.

Although not shown, the webbing may also be used to secure the second pair of manifolds to the core assembly.

A webbing made of reinforced plastic may be designed to provide a cooling path to correct for thermal limitations of the reinforced plastic.

The webbing is not limited to the number of layers or the layer orientation described above. A design choice, the number of layers wrapped around the core assembly may be selected to counter the expected loading on the manifolds.

The webbing is not limited to the wrapping patterns shown in the Figures. The webbing may partially surround the core assembly, it may completely surround the core assembly, it may be bonded to opposite sides of the core assembly, etc.

The number of webbing groups and specific placement of the webbing groups are also a design choice. Selective (e.g., highly loaded) areas of the heat exchanger may be wrapped to retain the manifolds in place.

The heat exchanger may be used in a variety of applications. The heat exchanger may be used as an air-to-air or other fluid-to-fluid heat exchanger. The fluids that can be handled range from hot exhaust gases to cryogenic fluids.

For example, the heat exchanger may be used as combination oil/fuel cooler. Oil passes through the hot side passageways and fuel passes through cold side passageways. Heat from the oil is transferred to the fuel. The webbing reduces the chances of the manifolds being separated from the core assembly and a fire being started.

Figure 6:
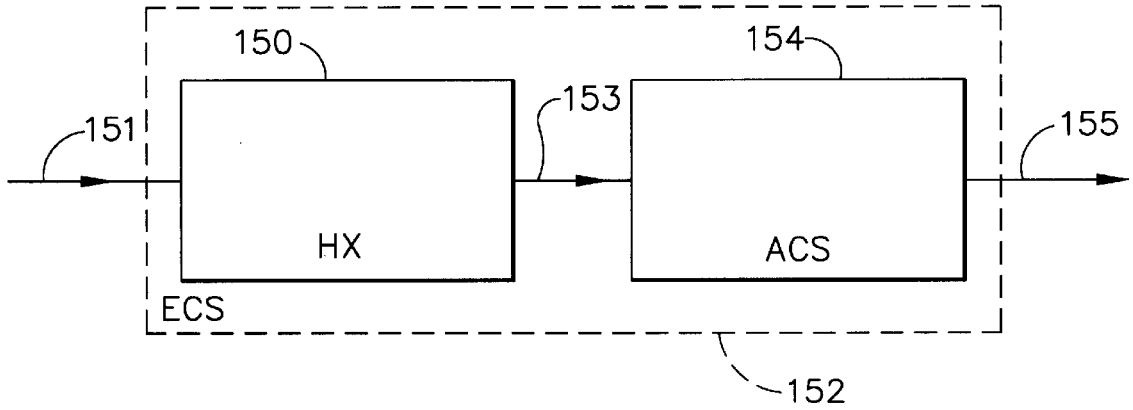
FIG. 6 is an illustration of an environmental control system including a heat exchanger having the manifold reinforcement webbing.

Referring now to FIG. 6, the heat exchanger 150 may be used in an aircraft environmental control system ("ECS") 152. Hot, compressed air (e.g., bleed air from a compressor stage of an aircraft engine) is supplied to the inlet manifold of the heat exchanger 150 (via passageway 151) and flows through hot side passageways in the core assembly. Heat of compression is transferred from the hot, compressed air to ambient air flowing through cold side passageways in the core assembly. The outlet manifold of the heat exchanger 150 is coupled to an inlet of an air conditioning system 154. The manifolds that direct the compressed air to and from the core assembly are secured to the core assembly by at least one reinforcement webbing.

The compressed air that has been cooled by the heat exchanger 150 is supplied to the air conditioning system 154 (via passageway 153). The air conditioning system 154 expands the bleed air and removes water droplets entrained in the bleed air via water separation or extraction. Cooled conditioned air leaving the air conditioning system 154 is supplied to an aircraft cabin or other closed compartment (via passageway 155).

The present invention is not limited to the specific embodiments described above. Instead, the present invention is construed according to the claims that follow.

What is claimed is:

1. A heat exchanger comprising:

a core assembly;

a plurality of manifolds for the core assembly; and a webbing wrapped around a portion of the core assembly, the webbing securing at least one manifold to the core assembly.

2. The heat exchanger of claim 1, wherein the webbing includes a plurality of strands.

3. The heat exchanger of claim 1, wherein the webbing includes multiple layers, the layers being oriented at different angles relative to one another.

4. The heat exchanger of claim 1, wherein the webbing is wrapped around manifolds that direct high pressure fluids to and from the core assembly.

5. The heat exchanger of claim 1, wherein the webbing is wrapped around substantially entire surfaces of the manifolds.

6. The heat exchanger of claim 1, further comprising additional groups of webbings for securing at least one manifold to the core assembly.

7. The heat exchanger of claim 1, wherein the webbing is wrapped around side plates of the core assembly.

8. The heat exchanger of claim 1, wherein the core assembly includes a plurality of reinforcement bars; and wherein the webbing extends along an end of at least one of the reinforcement bars.

9. The heat exchanger of claim 8, wherein a surface extends from at least one of the reinforcement bars, the extended surface supporting and channeling the webbing.

10. The heat exchanger of claim 1, wherein the webbing is wrapped around high stress areas of the heat exchanger.

11. A heat exchanger comprising:

a core assembly;

a plurality of manifolds for the core assembly; and webbing means for securing at least one manifold to the core assembly.

12. An environmental control system comprising:

an air conditioning system; and a heat exchanger including a core assembly having a hot fluid passageway; inlet and outlet manifolds for the hot fluid passageway; and a webbing wrapped around a portion of the core assembly, the webbing securing the inlet and outlet manifolds to the core assembly;

the outlet manifold being coupled to an inlet of the air conditioning system.

13. The system of claim 12, wherein the webbing includes a plurality of strands.

14. The system of claim 12, wherein the webbing includes multiple layers, the layers being oriented at different angles relative to one another.

15. The system of claim 12, wherein the webbing is wrapped around side plates of the core assembly.

16. The system of claim 12, further comprising additional groups of webbings for securing the manifolds to the core assembly.

17. The system of claim 12, wherein the core assembly includes a plurality of fins, plates and reinforcement bars; and wherein the webbing extends along an end of at least one reinforcement bars.

18. The system of claim 17, wherein a surface extends from at least one of the reinforcement bars, the extended surface supporting and channeling the webbing.

19. The system of claim 11, wherein the webbing is wrapped around high stress areas of the heat exchanger.

20. A method of securing heat exchanger manifolds to a heat exchanger core assembly, the method comprising the step of wrapping a webbing around portions of the manifolds and the core assembly.

* * * * *